US009637985B2

(12) United States Patent
Scott et al.

(10) Patent No.: US 9,637,985 B2
(45) Date of Patent: May 2, 2017

(54) PACKER RELEASE COMPACTION JOINT

(71) Applicant: HALLIBURTON ENERGY SERVICES, INC., Houston, TX (US)

(72) Inventors: Keith Wayne Scott, Lavon, TX (US); Colby M. Ross, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 204 days.

(21) Appl. No.: 14/409,268

(22) PCT Filed: Dec. 19, 2013

(86) PCT No.: PCT/US2013/076565

§ 371 (c)(1),
(2) Date: Dec. 18, 2014

(87) PCT Pub. No.: WO2015/094285

PCT Pub. Date: Jun. 25, 2015

(65) Prior Publication Data

US 2016/0273287 A1 Sep. 22, 2016

(51) Int. Cl.
*E21B 23/00* (2006.01)
*E21B 33/12* (2006.01)
(Continued)

(52) U.S. Cl.
CPC ..... *E21B 23/00* (2013.01); *E21B 23/06* (2013.01); *E21B 33/12* (2013.01); *E21B 33/128* (2013.01);
(Continued)

(58) Field of Classification Search
CPC ..... E21B 23/00; E21B 23/06; E21B 33/128; E21B 33/129; E21B 33/12; E21B 34/14; E21B 34/063
See application file for complete search history.

(56) References Cited

U.S. PATENT DOCUMENTS 5,375,662 A * 12/1994 Echols, III ..... E21B 23/04 166/187
5,542,473 A * 8/1996 Pringle ..... E21B 23/01 166/120
(Continued)

OTHER PUBLICATIONS

Halliburton Energy Services, Inc , "Flow Sub and Closing Sleeve Extensions", Sand Control Catalog, retrieved from the internet at http://www.halliburton.com/public/cps/contents/Books_and_Catalogs/web/SandControl/Section3_Downhole_Components.pdf, on Dec. 15, 2014, pp. 3-20 and 3-21, 2 pages.
(Continued)

*Primary Examiner* — Robert E Fuller
*Assistant Examiner* — Christopher Sebesta
(74) *Attorney, Agent, or Firm* — Kilpatrick Townsend & Stockton LLP

(57) ABSTRACT

Certain aspects are directed to a device designed to relieve compression in a length of pipe. The device provides a load ring that can absorb and isolate load until a shear sleeve is shifted and shear pins are sheared. A specific aspect provides a packer release compaction joint that has a shifting sleeve having a first internal shoulder configured to engage a shifting tool; a shear sleeve having a raised abutment; a load ring mounted on the shear sleeve, the load ring having an outer diameter and positioned forward of the first side of the raised abutment; a snap ring mounted around the outer diameter of the load ring. Action of a shifting tool against the first internal shoulder of the shifting sleeve causes the snap ring to move away from the load ring and move to the second side of the raised abutment.

17 Claims, 4 Drawing Sheets

(51) Int. Cl.

| | |
|---|---|
| ***E21B 34/14*** | (2006.01) |
| ***E21B 23/06*** | (2006.01) |
| ***E21B 34/06*** | (2006.01) |
| ***E21B 33/128*** | (2006.01) |
| *E21B 33/129* | (2006.01) |

(52) U.S. Cl.
CPC ..... *E21B 34/063* (2013.01); *E21B 34/14* (2013.01); *E21B 33/129* (2013.01)

(56) References Cited

U.S. PATENT DOCUMENTS

| | | | | |
|---|---|---|---|---|
| 6,003,607 | A | 12/1999 | Hagen et al. | |
| 2002/0170710 | A1* | 11/2002 | Doane | E21B 23/06 166/120 |
| 2011/0042107 | A1 | 2/2011 | Chambers et al. | |
| 2011/0114325 | A1* | 5/2011 | Coghill | E21B 23/00 166/332.3 |
| 2011/0284208 | A1 | 11/2011 | Macleod et al. | |
| 2012/0160521 | A1 | 6/2012 | McGlothen et al. | |
| 2012/0186824 | A1* | 7/2012 | Allen | E21B 23/02 166/373 |
| 2012/0325466 | A1 | 12/2012 | Themig | |
| 2013/0175040 | A1 | 7/2013 | Madero et al. | |

OTHER PUBLICATIONS

Halliburton Energy Services, Inc , "Positioning Tools", Sand Control Catalog, retrieved from the internet at http://www.halliburton.com/public/cps/contents/Books_and_Catalogs/web/SandControl/Section3_Downhole_Components.pdf, on Dec. 15, 2014, p. 3-45, 1 page.

Halliburton Energy Services, Inc , "Removable Absolute Isolation System (AIS) Components", Sand Control Catalog, at least as early as Apr. 5, 2013, Dec. 15, 2014, p. 3-25, 1 page.

Halliburton Energy Services, Inc , "Sand Control Packers for Multi-Position Systems: Versa-Trieve® Packers", Sand Control Catalog, retrieved from the internet at http://www.halliburton.com/public/cps/contents/Books_and_Catalogs/web/SandControl/Section3_Downhole_Components.pdf, on Dec. 15, 2014, p. 3-2 through 3-10, 9 pages.

International Patent Application No. PCT/US2013/076565, International Search Report and Written Opinion, mailed Sep. 24, 2014, 10 pages.

* cited by examiner

PACKER RELEASE COMPACTION JOINT

CROSS-REFERENCE TO RELATED APPLICATIONS

This is a U.S. national phase under 35 U.S.C. 371 of International Patent Application No. PCT/US2013/076565, titled "Packer Release Compaction Joint" and filed Dec. 19, 2013, the entirety of which is incorporated herein by reference.

TECHNICAL FIELD

The present disclosure relates generally to devices for use in a wellbore in a subterranean formation and, more particularly (although not necessarily exclusively), to a device designed to relieve compression in a length of pipe.

BACKGROUND

Various devices can be utilized in a well traversing a hydrocarbon-bearing subterranean formation. Many such devices are configured to be actuated, installed, or removed by a force applied to the device while disposed in the well. In one example, a packer device may be installed in production tubing in the well by applying a force to an elastomeric element of the packer. The elastomeric element may expand in response to the force. Expansion of the elastomeric element may restrict the flow of fluid through an annulus between the packer and the tubing. In another example, a force may be applied to a removable plug device to withdraw the plug from an installed position in the wellbore.

In these instances, removal of these devices from the well can be a challenge. For example, devices set in the well may be subjected to forces after they are locked in the casing. These forces may be thermally induced, induced by pressure, or through the application of mechanical forces from the tubing string or workstings. Once these forces exist, it may be difficult or impossible for normal function of the tools that are in the well. One such example of this is when a packer is set in the well and forces are applied to the bottom of the packer that prevent the slips from releasing from the casing to allow the packer to be pulled. In order to release this force, there is a need for a device that will eliminate the force on the packer.

DETAILED DESCRIPTION

Figure 1:
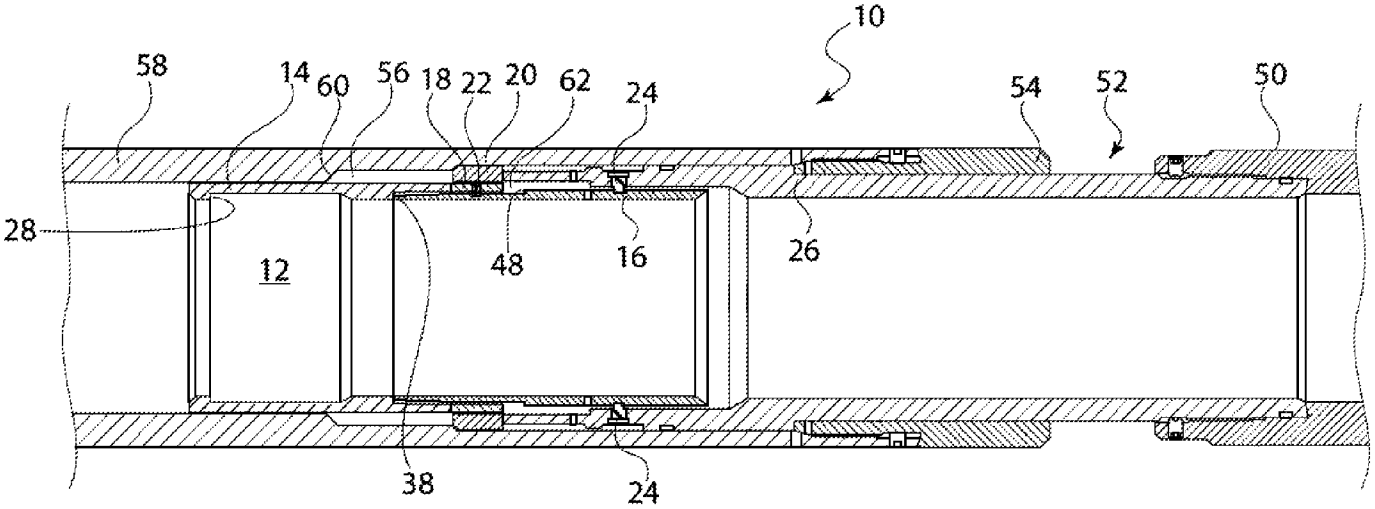
FIG. 1 is a side cross-sectional view of one embodiment of a packer release compaction joint in the run-in and compressed position.

Certain aspects and examples of the present disclosure are directed to a packer release compaction joint. The packer release compaction joint is intended to relieve compression in a length of pipe. In a particular aspect, the joint relieves compression in pipe below a packer in a wellbore. Packers are typically set with a slip that is wedged into the wellbore casing. The pipe below the packer release compaction joint may be gravel packed so that the pipe cannot move or may be closely spaced next to another device that is fixed within the well. When the packer is set, weight may have been applied down the workstring in the well. Other ways of applying force on the packer may also occur. For instance, the pipe below the packer may be cool when the packer is set. After the packer is set and the well warms, the pipe may expand and put force on the packer. During a gravel pack, the pipe may become fixed by the pack sand, not allowing any movement of the pipe below the packer.

Accordingly, when the packer is to be released, the slip on the packer may be difficult to remove from the casing because the pipe has to move downward in order to allow the wedge under the slip to release the teeth of the slip from the casing. This disclosure provides a packer release compaction joint that can relieve compression and create travel space in order to allow the slip to release from the casing if/when the packer should be pulled. The packer release joint relieves the compression in the pipe by shifting a sleeve that enables the device to scope inward and provide space for tubing movement to relieve pipe buckling and compression. This generally creates a space that provides enough distance for the lower wedge to move downward and allow the slip teeth to disengage before the packer is pulled.

These illustrative examples are given to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative aspects. The following sections use directional descriptions such as "above," "below," "upper," "lower," "upward," "downward," "left," "right," "uphole," "downhole," etc. in relation to the illustrative aspects as they are depicted in the figures, the upward direction being toward the top of the corresponding figure and the downward direction being toward the bottom of the corresponding figure, the uphole direction being toward the surface of the well and the downhole direction being toward the toe of the well. Like the illustrative aspects, the numerals and directional descriptions included in the following sections should not be used to limit the present disclosure.

One advantage of the packer release compaction joint is that because well completion tools are generally run at a very deep depths downhole, it is not always possible to tell whether the packer has released when the packer release is attempted. By creating the desired space during this release and retrieval process, the well operator can have a greater certainty that the packer may be retrieved successfully and that milling may not be required to retrieve the packer.

In one aspect, the packer release compaction joint can be a part of the completion string. The joint/tool may be run at a location in the completion string below the retrievable packer. In a typical sand control completion, this location could be below the extensions below the closing sleeve. In another embodiment, it may be run in at a lower end of a gravel pack assembly. In a specific aspect, the packer release compaction joint is positioned generally below a lower extension of the gravel pack assembly. It may be positioned above a screen. The packer release compaction joint need not act until the shift is needed to create the desired space. Alternatively, the shift may take place once the packer has been set. When desired, the joint allows the movement between a shifting sleeve and a shear sleeve to cause movement of the shifting sleeve, which creates the desired space in the tubing. The joint is designed to provide room for downward movement below the packer to aid in retrieving of the packer.

For example, if the packer is set after weight is slacked off of the workstring onto the completion below the packer, when it is time for the packer to be released, there is no slack in the completion string to allow the lower wedge of the packer to fall and release the lower end of the packer slip from the casing. Accordingly, the packer release compaction joint tool 10 provided in this disclosure and shown in FIGS. 1-3 absorbs the compression of the tool string between the packer and the compaction joint by the described stroke of the compaction joint.

Figure 4:
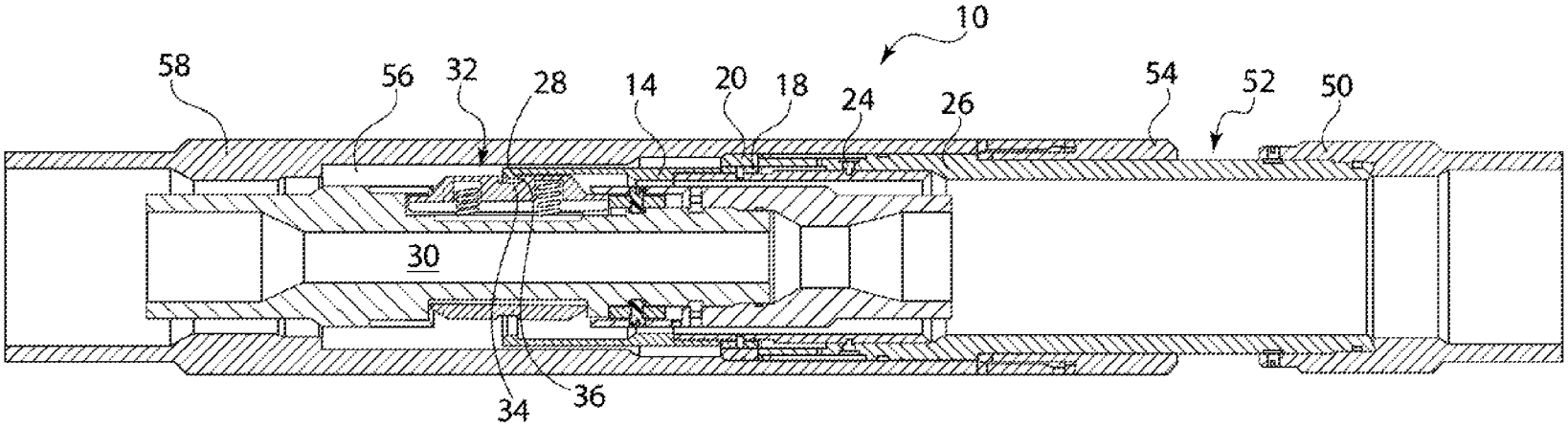
FIG. 4 is a side cross-sectional view of a packer release compaction joint in the run-in position, with a shifting tool in place.
Figure 5:
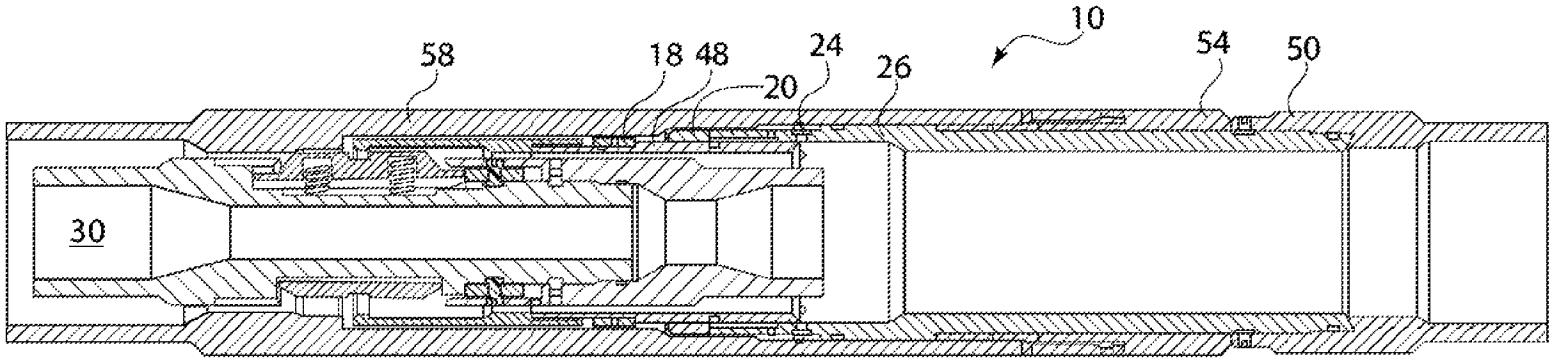
FIG. 5 is a side cross-sectional view of the packer release compaction joint of FIG. 4 after the joint has been shifted.

When the packer is ready to be pulled, a shifter or shifting tool 30 as shown in FIGS. 4 and 5 is connected to the bottom of a packer retrieving tool (such as a VRA type Versa-Trieve retrieving tool) and will be run downhole. The shifter will be connected to and extended below the retrieving tools so that it will be spaced out and located just below the compaction joint 10 before the retrieving tool engages the packer. The extension below the retrieving tool will be lowered through the packer and then pulled up far enough to allow the shifter 30 to shift the compaction joint shifting sleeve 14. This shifting of the shifting sleeve 14 releases compression between the lower wedge of the packer and the compaction joint 10. Releasing the compression will allow the lower wedge to be pulled away from the packer slip and allow it to disengage from the well casing. Once the shear sleeve 16 in the compaction joint shears shear screw 24, the retrieving tool can be lowered to engage and release the packer.

Figure 1A:
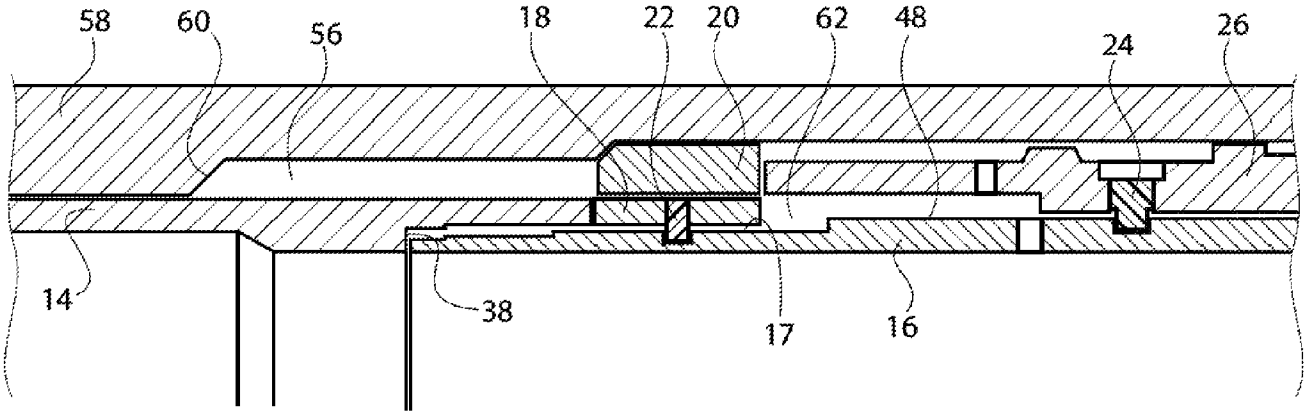
FIG. 1A is an exploded view of a portion of FIG. 1
Figure 2:
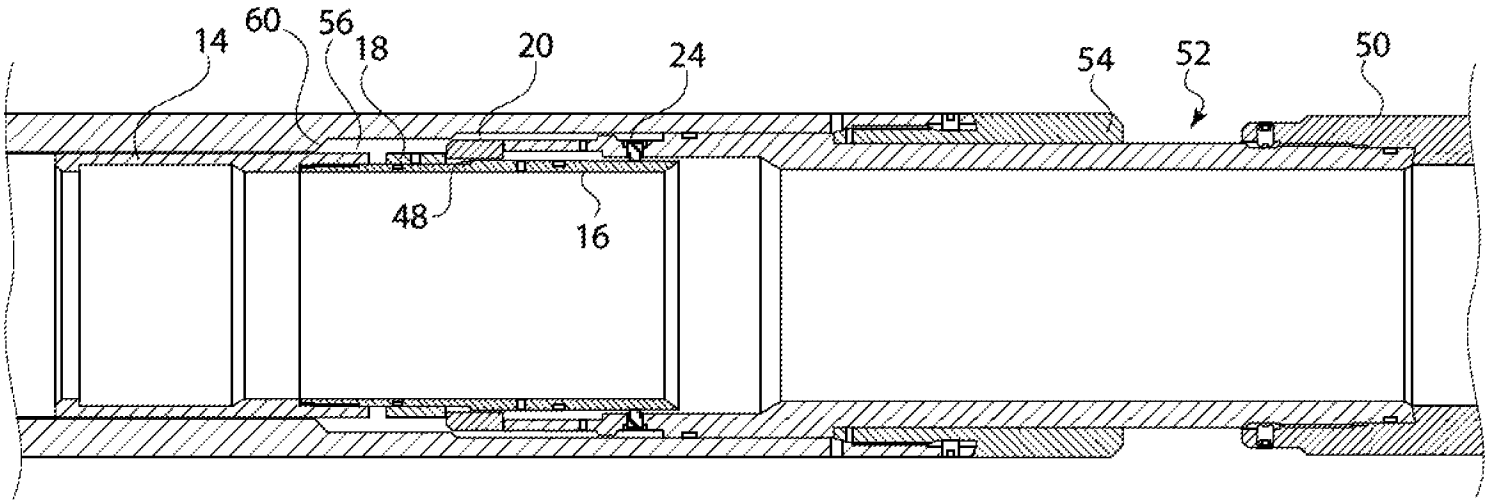
FIG. 2 is a side cross-sectional view of the packer release compaction joint of FIG. 1 as the shifting sleeve and shear sleeve are shifted to begin to release compression.
Figure 3:
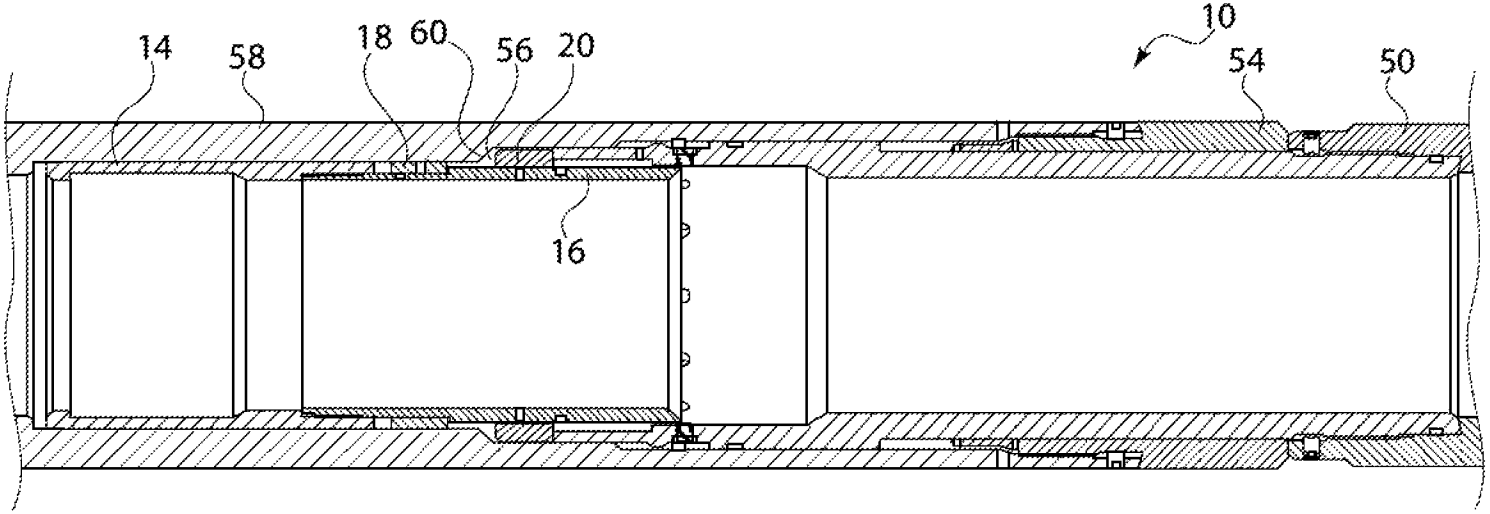
FIG. 3 is a side cross-sectional view of the packer release compaction joint of FIG. 1 with the sleeves shifted.

The disclosure now refers to the packer release compaction joint 10 shown in FIGS. 1-3. FIG. 1 and FIG. 1A show cross sectional views of a pipe 12 that supports the compaction joint 10 components. FIG. 1 shows a compaction joint 10 with a shifting sleeve 14, a shear sleeve 16, a load ring 18, a snap ring 20, a drive-lock pin 22, shear elements 24, and a mandrel 26. Other components are possible and shown, but in one aspect, the interaction between the above elements is what generally creates the desired movement/shift. This packer release joint 10 is not a part of the packer, but it is a stand-alone tool that may be located at some point generally below the packer on the completion string.

As shown in FIG. 1, the shifting sleeve 14 has an internal shoulder 28 that is sized for engagement with the shifting tool 30. An exemplary shifting tool and its interaction with the packer release joint 10 is shown in FIGS. 4 and 5. The shifting tool 30 is designed to engage the internal shoulder 28 and pull the shifting sleeve 14 when appropriate. The shifting tool 30 may be used to cause the packer release joint 10 to move and create space. In use, the shifting tool 30 may be run in on the washpipe of the sand control completion or an internal string.

The shifter or shifting tool 30 is generally located below a packer retrieving tool and used to release the compressive load from the compaction tool prior to pulling the packer. As shown in FIGS. 4 and 5, the shifting tool 30 has an engaging feature 32 that can engage the shoulder 28 of the shifting sleeve 14. The engaging feature 32 may be an internal indented area 34 on the tool 30 with a corresponding ledge 36 that can engage and move the shifting sleeve 14.

Referring back to FIG. 1, the shifting sleeve 14 may have an additional shoulder feature 38 that abuts a shear sleeve 16 such that the shear sleeve 16 and shifting sleeve 14 can contact one another. The shear sleeve 16 is pinned to the load ring 18 via a drive-lock pin 22. Shear sleeve 16 is also secured to the mandrel 26 via shear elements 24. As shown in FIG. 1, there may be two shear elements 24 around the circumference of the shear sleeve 16. Because the shear sleeve 16 is secured to the mandrel 26 via shear elements 24, when the shifting sleeve 14 and the shear sleeve 16 are moved or "shifted" with respect to the mandrel (which does not move), the shear elements 24 are caused to shear or break.

When the packer release joint 10 is in the well and confined between other tools such that the packer release joint 10 is in compression, loads are applied through the mandrel 26, against the snap ring 20, and into the top sub/outer tubing 58. When the load is applied, there is also a compressive load applied to the load ring 18, which can absorb and transfer this compressive load.

The load ring 18 is provided in order to prevent the compressive load that is applied to the packer release joint 10 from being applied to the shear sleeve 16 during the time that the shear elements 24 are sheared. The load ring 18 thus absorbs the compressive load and prevents this load from being applied to the sleeve 16. Without a load ring 18 in place, the force required to shift the shear sleeve 16 would be drastically increased, and possibly even made impossible, due to the frictional load that would otherwise exist between the upper surface 17 of the shear sleeve 16 and the snap ring 20 (without the load ring 18 in place). The frictional forces could even exceed the shear forces at loads of high magnitude.

The presence of the load ring 18 thus absorbs the compression load on the packer release joint 10 and transfers it elsewhere on the tool string. This load support/transfer eliminates compressive load on the shear sleeve 16, which allows movement of the shear sleeve 16 to shear the shear elements 24 when the shifting tool 30 is engaged in the internal shoulder 28 of the shifting sleeve 14. Due to the presence of load ring 18, the load required to shift the shear sleeve 16 is only the load required to shear the shear elements 24 plus the shear pins 22. The compression load resulting from the compression on the packer release joint 10 and the inward force on snap ring 20 is supported by the load ring 18.

The load ring 18 is designed to withstand this compression and to allow the sliding movement of the shear sleeve 16 beneath. The load ring 18 essentially "floats" along the surface 17 of shear sleeve 16 until the shear elements 24 are sheared. Without this floating/sliding fit of the load ring 18, the compression against the upper surface 17 of the shear sleeve 16 could require such a high value for shifting the shear sleeve 16 (and the subsequent shear of shear elements 24) that could prevent the shifting tool 30 from creating the desired movement at all (which would prevent the packer release joint 10 from being able to release the packer and create the desired space).

Thus, the load ring 18 can slide with little contact against the upper surface 17 of the shear sleeve 16. Because of this sliding fit, the frictional forces resulting from the compressive load on the load ring 18 do not add to the total force required to move sleeve 16 in order to shear screw screws 24 and pin 22.

The load ring 18 allows the packer release joint 10 to have the ability to absorb a large compressive load before that load is transferred through the joint and to the sleeves 14, 16 and shear elements 24. The load ring 18 can support a heavy load, which can be from about 50,000 to about 200,000 pounds of compression on a tool that might be used in 9⅝" casing. This range is provided as an example only and is not intended to be limiting of the loads that can be supported by devices provided in this disclosure.

It would also be difficult to know exactly what level of additional compression would be needed to prevent the shearing of the shear elements 24. By providing the load ring 18, the shear elements 24 are allowed to shear at the appropriate time under the appropriate load. The shear elements 24 alone may have a shear valve of around 20,000 pounds. Accordingly, the load ring 18 adds the ability of the packer release joint 10 to withstand a much greater amount of force and still be able to be shiftably released. Without the load ring 18 in position, the joint 10 would likely not be possible to shift with the combined shear and frictional loads. It would also be more difficult for the operator to reliably know when the shear elements 24 actually shear.

In one aspect, the shear sleeve 16 has a raised abutment 48. When the packer release joint 10 is in its compressed position as shown in FIG. 1, there is a space 62 between the load ring 18 and the raised abutment 48. As shown in FIG. 2, when the shear elements 24 are sheared, there is an impact load applied to the load ring 18, which allows the shear sleeve 16 to release from its position underneath the snap ring 20. Providing space 62 between the load ring 18 and a raised abutment 48 allows the force generated by the shearing of shear elements 24 to impact the load ring 18 at a high velocity, which can help the load ring 18/shear sleeve 16 move out from underneath the snap ring 20, as shown in FIG. 2. During the shifting of the packer release joint 10, this space 62 is closed, as shown in FIG. 3. The raised abutment 48 creates a support for the load ring 18 when compression is applied.

Figure 6:
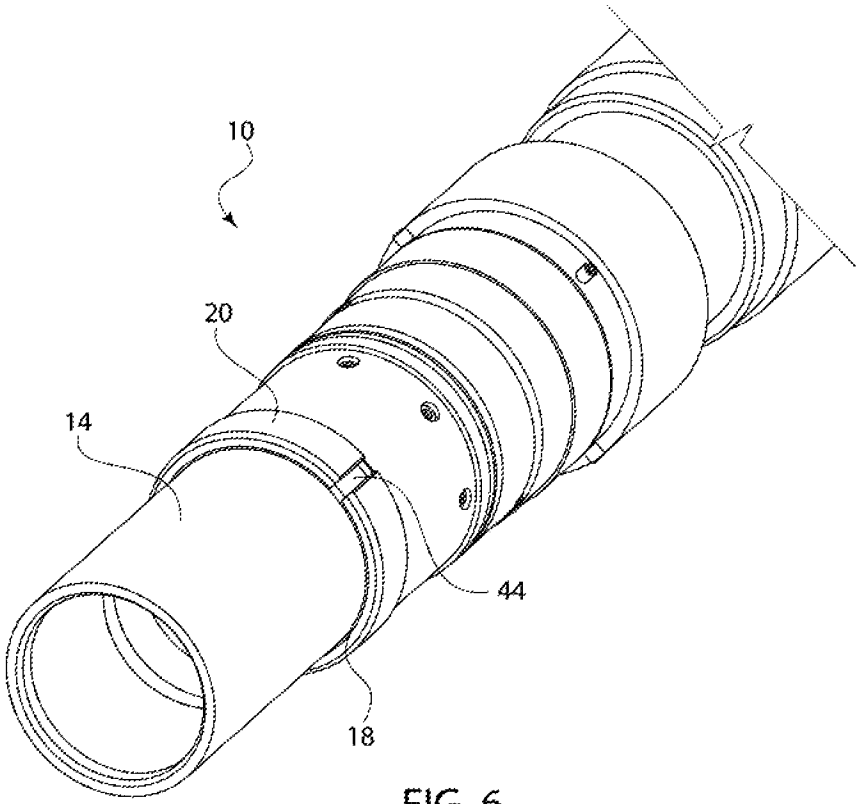
FIG. 6 is a perspective view of a packer release compaction joint.

The figures also show a snap ring 20 adjacent to the load ring 18. The snap ring 20 is locked in place in the packer release joint 10 and will absorb the compressive load placed on the packer in use. The load ring 18 located underneath the snap ring 20 prevents compressive load from being transferred to the shear sleeve 16. This will allow for a consistent shear value regardless of the compressive load placed on the snap ring 20. Snap ring 20 is shown as encircling the outer diameter of the load ring 18, as illustrated in FIG. 6. In this aspect, the load ring 18 is generally located below (or underneath) the snap ring 20.

In one aspect, snap ring 20 may be a C-shaped ring with a gap 44 cut therein. This gap 44 can allow the snap ring 20 to be sized to fit over the load ring 18 and back around the shear sleeve 16 once the packer release joint has been shifted, as shown in FIG. 3. The gap 44 allows the snap ring 20 to expand to the larger outer diameter of these areas. The gap 44 allows the snap ring 20 to slide off the load ring 18 upon movement of the shifting sleeve 14.

FIGS. 1 and 2 show a cavity 56 that exists with respect to the outer sub 58 and the shifting sleeve 14. As shown in FIG. 3, when the release step is to occur and the shifting tool 30 moves shifting sleeve 14 to release compression, the load ring 18 moves with the shifting sleeve 14/shear sleeve 16. Shifting sleeve 14 and shear sleeve 16 can be secured to one another in order to create a unified movement such that pressure on shifting sleeve 14 also moves shear sleeve 16. It is also possible for the shifting sleeve 14 and shear sleeve 16 to be provided as a single sleeve, if desired or appropriate for the wellbore application used.

As the shifting sleeve 14 continues to move to the left in the figures, the snap ring 20 slides over the load ring 18. One example of movement of the shifting sleeve 14/shear sleeve 16 is shown in FIGS. 2 and 3. In these figures, the shifting sleeve 14, shear sleeve 16, and load ring 18 move together and are shifted to the left of the page. (This shift may be an upward lateral shift in the wellbore, or a horizontal shift, depending upon the placement of the tooling). This movement causes the shear elements 24 to shear, in order to allow movement of the shear sleeve 16.

This movement also causes the snap ring 20 to move away from its abutment with the load ring 18. In FIG. 2, the snap ring 20 is shown moving over the raised abutment 48 of the shear sleeve 16. Further movement of the shifting sleeve 14, shear sleeve 16, and load ring 18 causes the snap ring 20 to move behind (or below) the abutment 48 and to move forward (or uphole) into the cavity 56, as shown in FIG. 3.

FIG. 2 shows the end joint 50 of the packer release joint 10 and a space 52 that is created between an end joint 50 and the tubing cap end 54. When the packer release joint 10 is compressed, the end joint 50 is spaced a distance 52 from the tubing end cap 54. This distance 52 is maintained at least in part by the location of load ring 18 and its ability to receive a compressive load without allowing shear elements 24 to shear. This distance 52 is also what allows the compression to be released when the shifting sleeve 14/shear sleeve 16 is pulled. The transition from FIGS. 2 to 3 illustrates how the continued force applied to the sleeves 14, 16 will allow the end joint 50 to close the space 52.

As shown, once snap ring 20 has moved into its collapsed position on the opposite side of raised abutment 48, continued movement of shifting sleeve 14/shear sleeve 16 creates a further shift of the shifting sleeve 14 into a space underneath the outer tubing 58 and the snap ring into cavity 56, as shown in FIG. 3. The shifting sleeve 14 and shear sleeve 16 and mandrel 26 are allowed to slide with respect to the outer tubing 58. Load ring 18 also moves further into the space beneath the outer tubing 58. The outer tubing 58 has a ledge 60 against which the snap ring 20 will abut to prevent further forward movement of the packer release joint 10.

After the shift, the compaction loads force the mandrel 26 forward (to the left of the page or uphole), which moves the end joint 50 up to close the distance 52 between tubing end cap 54 and the end joint 50, as shown in FIG. 3. Closing this distance 52 creates the space for release of the tubing loads and room for movement of the lower wedge to enable release of the packer.

Benefits of the design described include but are not limited to the ability to add the packer release joint to existing sand control completions without modification to the system. Another benefit is that the system takes up a short length in the completion, but the length can be lengthened as needed to address higher compressive loads if anticipated. A further benefit is that the packer release joint does not leave the completion in a floating state; the joint holds the pipe in a fixed position until the sleeve is shifted. Additionally, even if a packer is not set in compression, the reservoir in the well may experience compaction and/or thermal loads may cause compression loads below the packer, and this packer release joint can address those issues. A further benefit is that the joint does not separate, as a shear joint might separate. This means that the pipe below the device can be pulled after the joint has been shifted and has achieved the movement required to relieve compressive loads, without a second trip to retrieve the lower pipe.

Additionally, deepwater completions and the related rig movement may make it difficult to control the amount of tension or compression that is on the packer when the packer is set. The packer release joint described can mitigate the risks associated with pulling packers that have tailpipe in compression. Deepwater completions and the related rig movement associated with working from floating completion vessels may make it difficult to space out the sump packer seals in the lower end of the completion. The use of this joint in the string can allow the operator the opportunity to place some compression on the packer to ensure that the seals remain landed, even though that may mean the packer is set with compression below.

The foregoing description, including illustrated aspects and examples, has been presented only for the purpose of illustration and description and is not intended to be exhaustive or to limiting to the precise forms disclosed. Numerous modifications, adaptations, and uses thereof will be apparent to those skilled in the art without departing from the scope of this disclosure.

What is claimed is:

1. A release compaction joint tool, comprising:
(a) a shifting sleeve having a first internal shoulder configured for engagement with a shifting tool;
(b) a shear sleeve having a raised abutment;
(c) a load ring mounted on the shear sleeve by a shear element when the release compaction joint is in compression, the load ring having an outer diameter and positioned on a first side of the raised abutment; and
(d) a snap ring mounted around the outer diameter of the load ring when the release compaction joint is in compression, wherein when the release compaction joint tool is shifted, the shear sleeve moves such that the snap ring is located on a second side of the raised abutment.

2. The release compaction joint of claim 1, further comprising a mandrel and one or more shear elements securing the mandrel to the shear sleeve.

3. The release compaction joint of claim 1, further comprising an outer tubing with a cavity defined by a ledge against which the snap ring abuts when the release compaction joint is shifted.

4. The release compaction joint tool of claim 1, wherein action of a shifting tool against the internal shoulder of the shifting sleeve releases compression.

5. The release compaction joint of claim 1, further comprising
(e) a mandrel in abutment with the snap ring and
(f) an end joint, wherein the mandrel and the end joint are moveable with respect to one another.

6. A packer release compaction joint tool, comprising:
(a) a shifting sleeve having a first internal shoulder configured for engagement with a shifting tool;
(b) a shear sleeve having a raised abutment;
(c) a load ring mounted on the shear sleeve, the load ring having an outer diameter and positioned on a first side of the raised abutment; and
(d) a snap ring mounted around the outer diameter of the load ring, wherein the snap ring is C-shaped with a gap in its circumference.

7. A packer release compaction joint tool, comprising:
(a) a shifting sleeve having a first internal shoulder configured for engagement with a shifting tool;
(b) a shear sleeve having a raised abutment;
(c) a load ring mounted on the shear sleeve, the load ring having an outer diameter and positioned on a first side of the raised abutment;
(d) a snap ring mounted around the outer diameter of the load ring,
(e) a mandrel in abutment with the snap ring;
(f) an end joint, wherein the mandrel and the end joint are moveable with respect to one another, and
(g) one or more shear elements between the shear sleeve and the mandrel.

8. The packer release compaction joint of claim 7, wherein the packer release compaction joint is configured to be run into a wellbore with tubing, and wherein the mandrel and end joint extend from an end of the tubing to create a distance between the end joint and the tubing.

9. The packer release compaction joint of claim 8, wherein action of a shifting tool against the first shoulder of the shifting sleeve causes the end joint to move up to close the distance between the end joint and the tubing.

10. A release compaction joint, comprising:
(a) a shifting sleeve having a first internal shoulder for engagement with a shifting tool;
(b) a shear sleeve having a raised abutment and an end abutting the shifting sleeve;
(c) a load ring mounted on the shear sleeve, the load ring having an outer diameter and positioned on a first side of the raised abutment;
(d) a snap ring mounted around the other diameter of the load ring;
(e) a mandrel that applies compressive loads to the snap ring, which are absorbed by the load ring, wherein the mandrel is removable secured to the shear sleeve via one or more shear elements;
(f) an end joint that is moveable with respect to the mandrel;
(g) a space created between the mandrel and the end joint when the packer release joint is in a first compression position, wherein shifting of the shifting sleeve and the shear sleeve to shear the shear elements causes movement of the end joint to close the space.

11. The packer release compaction joint of claim 10, further comprising an outer tubing with a cavity defined by a ledge against which the snap ring abuts when the packer release compaction joint is shifted.

12. The packer release compaction joint of claim 11, wherein action of a shifting tool against the first internal shoulder of the shifting sleeve causes the snap ring to slide over the load ring, the shifting sleeve and the shear sleeve to move under the outer tubing, and the snap ring to move into the cavity.

13. The packer release compaction joint of claim 10, wherein action of a shifting tool against the first internal shoulder of the shifting sleeve releases the first compression position.

14. A method for isolating load on a pipe from shear compression, comprising:
(a) providing a release joint comprising:
(i) a shifting sleeve having a first internal shoulder for engagement with a shifting tool;
(ii) a shear sleeve having a raised abutment and an end abutting the shifting sleeve;
(iii) a load ring mounted on the shear sleeve, the load ring having an outer diameter and positioned on a first side of the raised abutment;
(iv) a snap ring mounted around the other diameter of the load ring;
(v) a mandrel that applies compressive loads to the snap ring, which are absorbed by the load ring, where in the mandrel is removably secured to the shear sleeve via one or more shear elements;
(vi) an end joint is moveable with respect to the mandrel;
(b) providing a shifting tool;
(c) engaging the shifting tool with the first internal shoulder of the shifting sleeve;
(d) applying force to the shifting tool.

15. The method of claim 14, wherein applying force to the shifting tool causes movement of the shifting sleeve and the shear sleeve, causes a shear of the one or more shear elements, and causes movement of the snap ring away from the load ring.

16. The method of claim 14, wherein action of a shifting tool against the first internal shoulder of the shifting sleeve causes the snap ring to slide over the load ring.

17. The release compaction joint tool of claim 16, wherein the shifting sleeve comprises a second shoulder to abut a shear sleeve.

* * * * *